US007900685B2

(12) United States Patent
Bolton

(10) Patent No.: US 7,900,685 B2
(45) Date of Patent: Mar. 8, 2011

(54) INVESTMENT CASTING

(75) Inventor: Anthony Wilfred Bolton, Leicester (GB)

(73) Assignee: Process Technology (Europe) Limited, Coventry (GB)

( * ) Notice: Subject to any disclaimer, the term of this patent is extended or adjusted under 35 U.S.C. 154(b) by 0 days.

(21) Appl. No.: 11/568,560

(22) PCT Filed: May 6, 2005

(86) PCT No.: PCT/GB2005/001745

§ 371 (c)(1),
(2), (4) Date: Jan. 15, 2007

(87) PCT Pub. No.: WO2005/107977

PCT Pub. Date: Nov. 17, 2005

(65) Prior Publication Data

US 2008/0216984 A1 Sep. 11, 2008

(30) Foreign Application Priority Data

May 6, 2004 (GB) ..... 0410272.9

(51) Int. Cl.
*B22C 7/02* (2006.01)
*B22C 9/04* (2006.01)

(52) U.S. Cl. ..... 164/35; 164/45; 164/235

(58) Field of Classification Search ..... 164/35, 164/131, 235, 45; 264/460
See application file for complete search history.

(56) References Cited

U.S. PATENT DOCUMENTS

| | | | | |
|---|---|---|---|---|
| 3,822,138 | A * | 7/1974 | Noguchi et al. | 106/38.8 |
| 3,847,202 | A | 11/1974 | Vaughn et al. | |
| 4,655,276 | A | 4/1987 | Bird et al. | |
| 4,940,072 | A * | 7/1990 | Pellman et al. | 164/35 |
| 5,176,188 | A * | 1/1993 | Quinn et al. | 164/516 |
| 6,582,197 | B2 * | 6/2003 | Coulson | 416/241 R |

FOREIGN PATENT DOCUMENTS

| | | | |
|---|---|---|---|
| EP | 1 029 515 | A1 | 8/2000 |
| GB | 1457046 | A | 12/1976 |
| JP | 56-117857 | A | 9/1981 |
| JP | 61-30257 | * | 2/1986 |

OTHER PUBLICATIONS

International Search Report for PCT/GB2005/001745 mailed Feb. 8, 2005.

* cited by examiner

*Primary Examiner* — Kuang Lin
(74) *Attorney, Agent, or Firm* — Caesar, Rivise, Bernstein, Cohen & Pokotilow, Ltd.

(57) ABSTRACT

In an investment casting procedure using microwave energy as the heat source virgin wax models are attached to a spree of wax-type pattern material incorporating a susceptor, the spree having a pour cup also of a wax-type pattern material, the pour cup material having a higher percentage of the susceptor than the material of the spree. In use the pour cup will melt first and the spree second, unblocking the path of the virgin wax so that its expansion will not crack ceramic with which it has been coated.

12 Claims, 2 Drawing Sheets

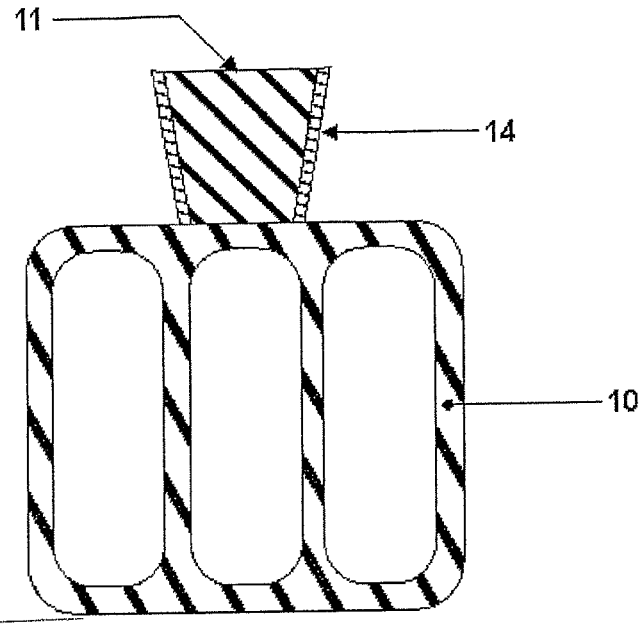
Fig 1.
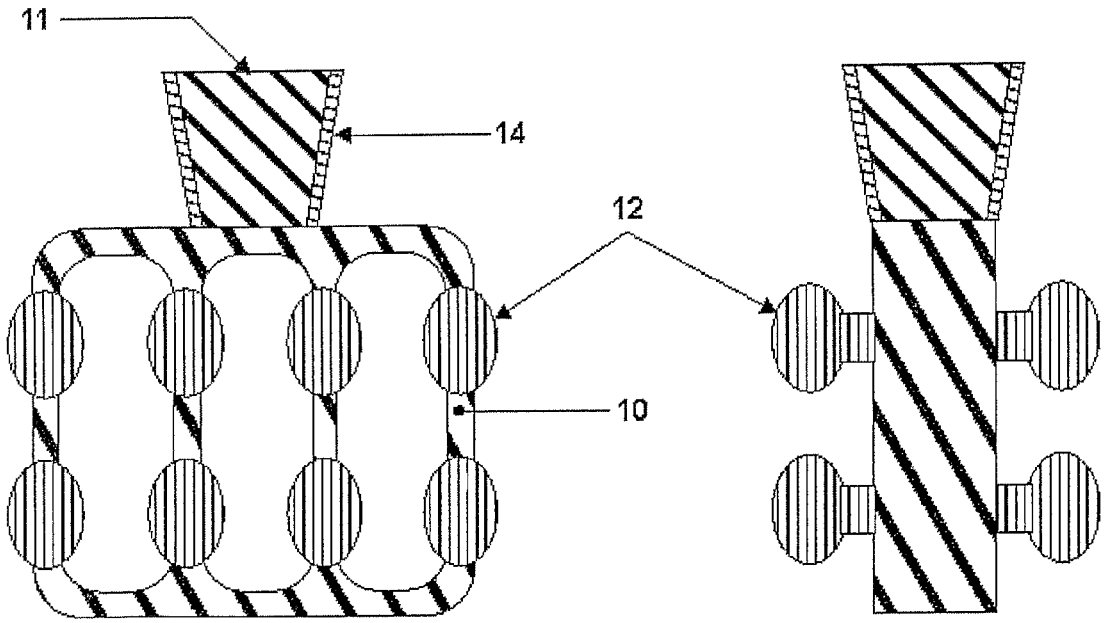
Fig 2A
Fig 2B

INVESTMENT CASTING

BACKGROUND OF THE INVENTION

This invention relates to improvements in investment casting and more particularly to improvements in an investment casting procedure where the heat utilised to melt the wax-type pattern and to sinter the ceramic mould is provided by microwave energy.

In investment casting first a model of the article to be moulded, usually from molten metal, is wax injected into a reverse engineered mould, or fabricated from a wax type pattern material. The pattern material may be natural or synthetic wax, polystyrene, or blends of various waxes, thermoplastic materials usually, but not exclusively, including fillers such as adipic acid and plasticizers. As used herein and in the appended claims the expression "wax type pattern material" is intended to include all such heat fusible pattern materials suitable for use in a "lost wax" moulding procedure. Typically a number of similar models are attached to a "sprue" to form a "tree" of the pattern material and the whole is coated several times typically, but not exclusively, with ceramic slurry and sand type material. The ceramic coating is then dried to provide a hard mould around the "wax type pattern material". The pattern material is melted out and the ceramic "shell" is sintered and molten metal is then poured into the "shell" void. When the metal has hardened the ceramic shell can be removed.

Investment casting using conventional sources of heat is a very lengthy and expensive procedure. It has been proposed e.g. in British Patent No. 1 457 046 to use microwave energy, thereby shortening the procedure and making it more economical. However the principal problems encountered in investment casting arise from differential expansion and contraction of the different materials involved when being heated up and cooled down. A particular danger is that if the pattern material cannot escape fast enough from the ceramic shell when being melted it may crack the shell due to its expansion. British Patent No. 1 457 046 offers as a solution to this problem the inclusion in the ceramic slurry of a so called "lossy material" which will induce a rapid melting of the pattern material adjacent to the shell. The solution however is imperfect especially when moulding articles of such a shape that the pattern material can only escape from the ceramic shell through a restricted bottle-neck, sprue or pour cup. If the material of the sprue is not melted first, or is imperfectly melted, the escape path for the rapidly expanding material within the shell is blocked with the result that the shell may be cracked.

It has been proposed in Japanese patent publication JP56117857 to use a resin type mould that can be melted out of the shell without deformation or cracking. This solution however is imperfect as it relies on placing the resin mould into a container of water allowing the water to penetrate through the honeycomb sections of the mould by capillary action. By this technique the volume of water will be generally constant throughout the mould where exposed above the water surface, i.e. there will be no gradient of susceptor content throughout different areas of the mould. Moreover this type of resin moulding cannot be used on high specification finishes of the cast components (such as aero engine blades) without a further polishing process, due to the manufacturing type of process of resin moulds, which do not produce a smooth finish to the casting.

A principle object of the present invention is to resolve these problems by providing a differential melting characteristic for wax pattern material in different parts of the mould, such that material in a sprue or other restricted opening will melt before material in other areas of the mould upstream of the opening. Thus when the latter material in turn becomes molten its escape route is not blocked and it can exit the mould while expanding without endangering the mould shell. The current virgin wax patterns, which must be used in the production of engine blades, can be used in accordance with this invention.

SUMMARY OF THE INVENTION

In accordance with the present invention there is provided an investment casting procedure using microwave energy as a heat source, characterised in that models of virgin wax are attached to a sprue of a wax-type pattern material incorporating a susceptor having a relatively greater heat absorption characteristic than the virgin wax and the sprue is attached to a pour cup of a wax-type pattern material incorporating a greater percentage of said susceptor than is incorporated in the material of the sprue.

The susceptor may be confined to regions of the sprue and the pour cup which will be restricted openings of the mould when the wax-type pattern material is melted.

The susceptor may be water, carbon, graphite or any combination thereof.

A tree on which multiple virgin wax models are mounted may incorporate said susceptor and may have a pour cup which incorporates a greater percentage of said susceptor than the remainder of the tree.

The susceptor content of the tree may be in the region of 12% and the susceptor content of the pour cup may be in the region of 15%.

A preferred embodiment of the invention will now be described by way of non-limitative example with reference to the accompanying drawings, in which:

BRIEF DESCRIPTION OF SEVERAL VIEWS OF THE DRAWINGS

FIG. 1 is a front elevation of a sprue with a pour cup;

FIGS. 2A and 2B respectively illustrate the sprue of FIG. 1 in front and side elevation with multiple models attached, so that it is now called a tree.

DETAILED DESCRIPTION OF THE PREFERRED EMBODIMENTS

Figure 3:
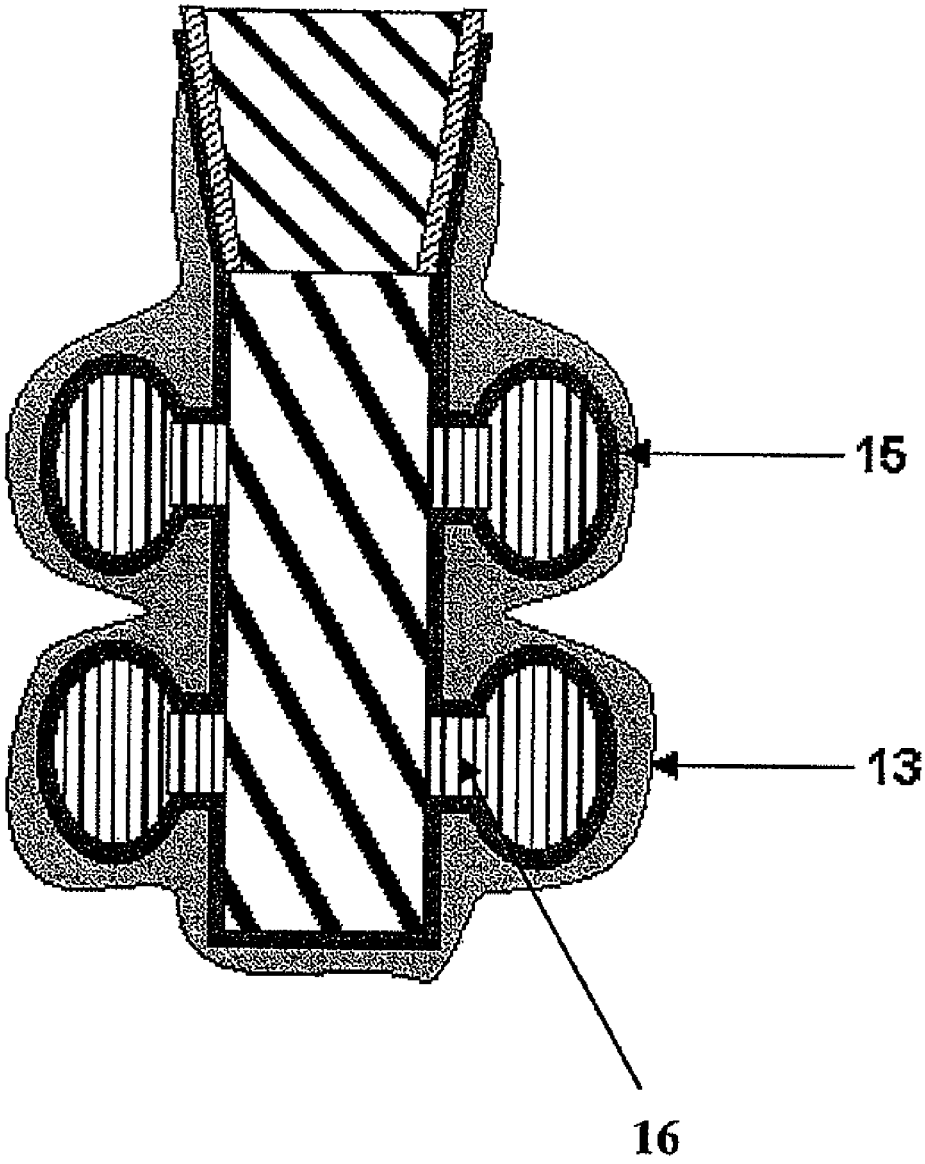
FIG. 3 illustrates the tree of FIGS. 2A and 2B in side elevation showing that the whole has been coated with a ceramic material.

The drawings illustrate a sprue 10 having a pour cup 14 filled with wax-type material 11. Models 12 of articles to be moulded are attached to the sprue by wax, glue or hot knife attachment. As is known per se all of the models 12, the sprue 10 and the pour cup 11 are fabricated from a wax-type pattern material. In accordance with the present invention, however, the sprue 10 has a higher percentage of susceptor content than the virgin wax models 12 and the pour cup 11 has a higher susceptor content than the sprue 10. The models 12 are virgin wax and the sprue 10 and the pour cup 11 are made up from reclaimed wax emulsions with known fixed percentages of susceptor in the emulsions.

The prime sand coat has a percentage of susceptor, likely to be carbon, graphite or any other suitably susceptible material or any combination thereof The entire assembly, the tree, 10, 11, 12 and 14 is prime coated with a ceramic slurry. While still wet the prime coat 15 is covered with the susceptible prime sand coat and then dried. Any number of additional coats of ceramic slurry 13 and sand are then applied to the prime coat to build up a ceramic shell of the desired thickness. The tree is then stood on the pour cup 14 over an opening in a microwave oven (not shown) and microwave energy is used to melt the wax-type material, which is now encased in a dried ceramic shell 13. Because of its higher susceptor material content the pour cup 1 will melt first and run out of the oven where it may be collected for reclamation. The material of the sprue 10 will melt next and run out through the pour cup thus unblocking the exits 16 from the models 12 enabling the virgin wax to run out when melted.

The doped prime coat will heat up, thus melting the pattern material adjacent to it. Due to the exits 16 from the pattern material being unblocked by prior melting of the sprue and pour cup the resulting melting of the virgin wax, by thermal transfer, will not endanger the shell 13.

Microwave energy is continuously applied to sinter the ceramic material and until the shell reaches an elevated temperature, e.g. 1000 degrees centigrade, whereupon it is cooled to pouring temperature, and metal, at a similar temperature, is poured into it through the pour cup 14. Alternatively the ceramic shells can be cooled to ambient temperature and supported mechanically, usually by sand, while being filled with molten metal. After the casting has cooled and the metal hardened the shell 13 can be removed conventionally and the individual articles can be removed from the sprue and finished in the conventional way.

It will be apparent that the procedure of the present invention is not limited to the use of a tree such as 10 and to the simultaneous casting of multiple moulds. In any investment casting procedure using microwave energy as the heat source the wax-type pattern material in the region of a restricted opening of a cast ceramic shell may be given a higher susceptor content than the remainder of the pattern material, thus ensuring that the pattern material can run out of the shell before its expansion endangers the shell during the start of the sintering process.

The invention claimed is:

1. A method of manufacturing a mould for use in investment casting comprising the steps of:

(a) creating a model of the article to be moulded in wax type pattern material;

(b) applying a ceramic slurry of at least one coat to build up a shell of desired thickness, the model having a portion for forming an opening within the interior of the shell after the model is melted out of the shell;

(c) using microwave energy to melt the model out of the ceramic shell and sinter the ceramic material;

wherein the model is provided with a differential melting characteristic in different parts thereof, such that wax type pattern material downstream of the portion will melt before the model upstream of the portion when exposed to the microwave energy.

2. The method of claim 1 comprising moulding the model in virgin wax.

3. The method of claim 1 wherein at least one model is fastened to a sprue of wax type pattern material prior to application of the ceramic slurry wherein the wax type pattern material of the sprue is provided with a differential melting characteristic from the model.

4. The method of claim 3 wherein the sprue further comprises a pour cup of wax type pattern material wherein the wax type pattern material of the pour cup has a differential melting characteristic from the model and from the sprue.

5. The method of claim 4 wherein the wax type pattern material of the pour cup will melt more quickly than that of the sprue.

6. The method of claim 5 wherein the differential melting characteristic is provided by the incorporation of a susceptor into the wax type pattern material.

7. The method of claim 1 wherein said at least one coat of ceramic slurry comprises a susceptor material.

8. The method of claim 3 wherein the susceptor content of the sprue is less than the susceptor content of the pour cup.

9. The method of claim 8 wherein the susceptor content of the sprue is about 12% and the susceptor content of the pour cup is about 15%.

10. The method of claim 6 wherein the susceptor is carbon.

11. The method of claim 6 wherein the susceptor is water.

12. A method of manufacturing a metal item by investment casting said method of investment casting comprising the steps of:

(a) preparing a mould through the method of claim 7;

(b) filling a mould with molten metal;

(c) allowing the molten metal to cool;

(d) removing the mould.

* * * * *